United States Patent [19]

Blumberg

[11] Patent Number: 4,950,097

[45] Date of Patent: Aug. 21, 1990

[54] FILE FOLDER AND METHOD OF MANUFACTURE

[75] Inventor: Murray B. Blumberg, Woodmead Springs Sandton, South Africa

[73] Assignee: Technokantoor Ltd., Brussels, Belgium

[21] Appl. No.: 215,604

[22] Filed: Jul. 6, 1988

[51] Int. Cl.[5] ..... B42F 13/06; B42F 13/08

[52] U.S. Cl. ..... 402/8; 402/14; 402/18

[58] Field of Search ..... 402/14, 15, 18

[56] References Cited

U.S. PATENT DOCUMENTS

| | | | |
|---|---|---|---|
| 421,028 | 2/1890 | Jones | 402/14 |
| 910,194 | 1/1909 | Harris | 402/14 |
| 1,096,181 | 5/1914 | Mieden | 402/14 |
| 1,138,872 | 5/1915 | Hub, Jr. | 402/18 |
| 1,500,339 | 7/1924 | Smiley, Jr. | 402/14 |
| 1,577,558 | 3/1926 | Brown et al. | 402/14 |
| 1,652,205 | 12/1927 | Kline | 402/14 |
| 1,665,128 | 4/1928 | Cather | 402/14 |
| 1,665,705 | 4/1928 | Kline | 402/14 |
| 1,744,948 | 1/1930 | Nuckland | 402/14 |
| 1,912,182 | 5/1933 | Di Girolamo et al. | 402/14 |
| 1,930,648 | 10/1933 | Kline | 402/14 |
| 2,005,717 | 6/1935 | Coulston | 402/14 |
| 2,265,404 | 12/1941 | Stark | 402/14 |
| 2,336,619 | 12/1943 | Karlen | 402/14 |
| 2,596,600 | 5/1952 | Rice | 402/14 |
| 2,725,881 | 12/1955 | Goldman | 402/14 |
| 3,271,829 | 9/1966 | Corey | 402/14 |
| 4,192,620 | 3/1980 | Jahn | 402/15 |
| 4,285,104 | 8/1981 | Corey et al. | 402/14 |

FOREIGN PATENT DOCUMENTS

| | | | |
|---|---|---|---|
| 220340 | 8/1957 | Australia | 402/14 |
| 1128839 | 5/1962 | Fed. Rep. of Germany | 402/14 |

*Primary Examiner*—Paul A. Bell

*Attorney, Agent, or Firm*—Wood, Herron & Evans

[57] ABSTRACT

A file folder and fastener combination wherein the folder has a pair of spaced, colinearly aligned, elongated slots separated by a medial portion of the folder and the fastener has a central body portion overlying and attached to the medial portion of the folder and with elongated prongs of the fastener overlying the slots. The folder has a cover over the central portion of the fastener such that the central portion of the fastener will not hang up on and damage adjacent file folders when multiple file folders are filed in a common file cabinet.

7 Claims, 4 Drawing Sheets

FILE FOLDER AND METHOD OF MANUFACTURE

This invention relates to file folders, and more particularly, to file folders of the type which have metal fasteners connected thereto for securing loose papers to the file folders.

Cardboard files or file folders are commonly used in combination with metal fasteners for securing loose papers to or within the folder. Generally, such fasteners comprise an elongated central body with elongated prongs extending from opposite ends of the central body. These fasteners are supplied to consumers either separately from the cardboard folders, or, alternatively, with the fastener attached to the file folder. In either event, in order to assemble the fastener to the file folder, it is necessary to bend the prongs into a position normal or perpendicular to the elongated body, and then push the prongs through slots in the folder so that the body of the fastener is located on the outside of the file with the prongs extending into the inside of the folder. The prongs are then bent down against the inside surface of the file folder so as to secure the fastener to the file and facilitate closure of the folder.

One shortcoming of file folders and fasteners of the type wherein the fastener is attached to the folder prior to sale of the folder to the consumer is that assembly of the fastener to the folder is expensive and requires expensive equipment to effect the assembly. The expense is primarily attributable to the necessity to form the fastener as a flat sheet of material, to bend it so that the prongs of the fastener are located normal to the central portion of the fastener, to push the prongs of the fastener from the outside of the folder through slots or openings in the folder and to then bend the prongs of the fastener down against the inside of the folder.

It has therefore been one objective of this invention to provide a new and improved file folder and fastener combination which may be manufactured and assembled much less expensively than heretofore possible.

Another objective of this invention has been to provide a new and improved file folder and fastener combination in which the fastener may be attached to the folder without the necessity to bend the fastener in order to effect the attachment.

Another problem characteristic of all file folder and fastener combinations is that the central body portion of the fastener which is located on the outside or exposed side of a file folder tends to catch or hang up on adjacent file folders when multiple file folders are filed in a filing cabinet. This results in damage to the files and inconvenience in filing multiple files.

It has therefore been another objective of this invention to provide an improved file folder and fastener combination which avoids the problem of the central portion of a fastener hanging up on and damaging adjacent files contained in a common file cabinet.

The file folder and fastener combination of this invention which achieves these objectives comprises a folder having a pair of spaced, colinearly aligned, elongated slots separated by a medial portion of the folder, and a fastener having a central body portion and a pair of opposed elongated prongs extending from opposite ends of the central body portion with the central body portion of the fastener overlying and secured to one side of the folder and with the prongs of the fastener overlying the elongated slots of the folder. The folder is preferably formed with a flap such that the fastener may either be secured to the flap or to the folder at a location adjacent the flap. In either event, after assembly of the fastener with the folder, the flap may be folded to cover the central body portion of the fastener.

As an alternative to utilizing a flap of the folder to cover the central body portion of the fastener, or to attaching the fastener to a flap and using the folder itself to cover the central body portion of the fastener, a separate covering element or member may be utilized to cover the central body portion of the fastener after the fastener if attached to the folder. In one preferred embodiment of the invention, the covering member is a flap of a second sheet or panel of the folder which folds over the surface of the folder to make a covering sheet over the fastener.

Irrespective of whether the fastener is attached to the folder or to a flap of the folder, the novel fastener and folder combination of this invention lends itself to a novel method of forming the fastener and attaching it to the folder. This method is substantially less expensive than prior methods of manufacturing and assembling folders and fasteners.

According to the practice of this method, spaced, colinearly aligned, elongated slots are cut from folders, and multiple sheet metal fasteners are sequentially and incrementally cut from a plate of sheet metal. A precut folder is positioned relative to a partially formed fastener such that the end portions of the partially formed fastener are aligned with the elongated slots of the folder. The partially formed fastener is then separated from the plate of sheet metal to complete the forming of the fastener and simultaneously moved into contact with one side of the folder to which the fastener is then connected. In one embodiment, the fastener is secured to the folder by deforming rivets previously formed in the fastener, and in another embodiment, the fastener is secured to the folder by deforming tabs previously formed on the fastener.

The primary advantage of this method of forming the fasteners and securing them to the folder is that all movable elements of the forming and assembling machine may be located on one side of the folder. There is therefore no need for movable elements on both sides of the folder with the movable elements on one side to effect movement of the fastener into contact with the folder and movable elements on the other side to control bending of the fastener. The invention of this application eliminates all need for bending of the end prongs of the fastener in order to effect assembly of the fastener to the folder. Consequently, there is a substantial savings in the cost of manufacturing and assembling the folder and fastener.

These and other objects and advantages of this invention will be more readily apparent from the following description of the drawings in which.

Figure 1:
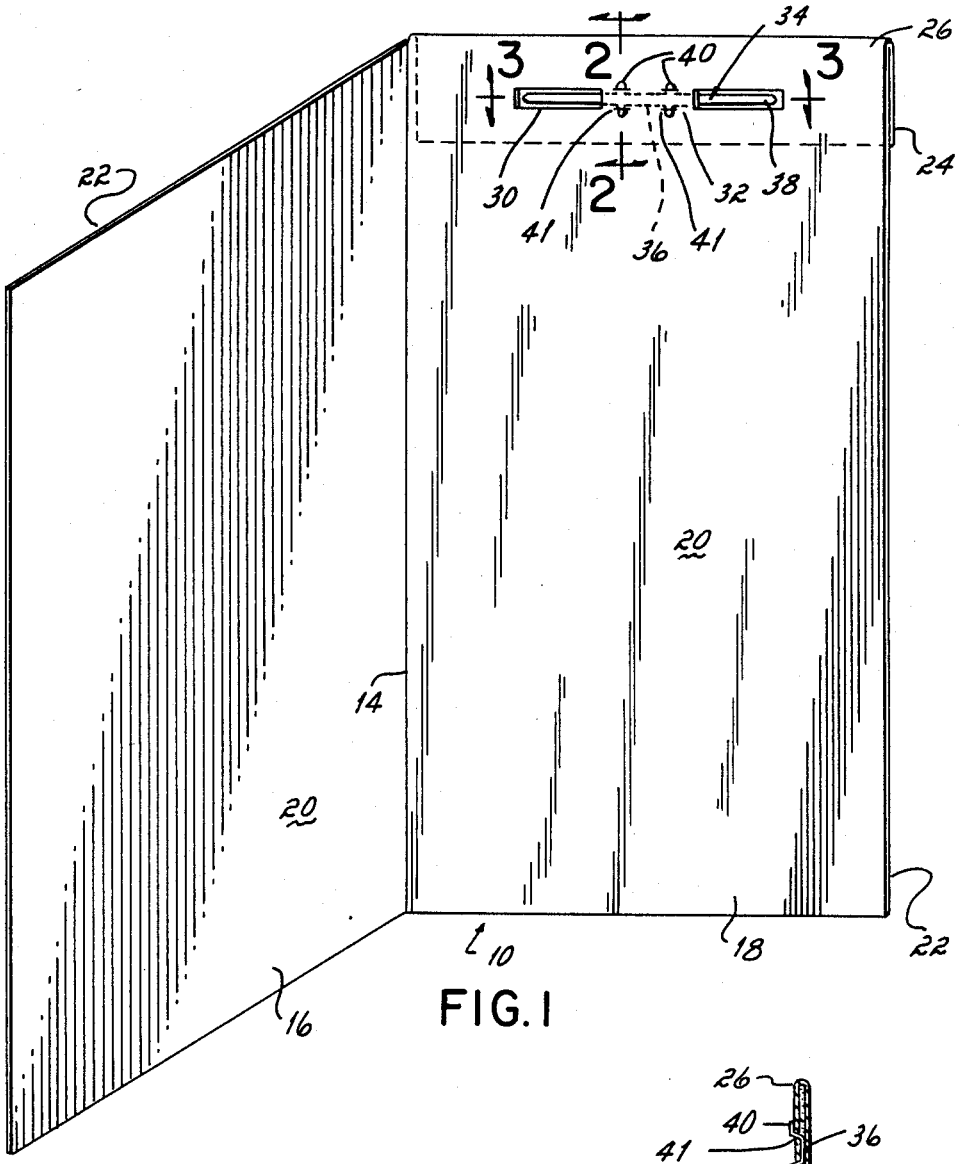
FIG. 1 is a perspective view of a file folder and fastener combination incorporating the invention of this application.

With reference first to FIG. 1, there is illustrated a file folder 10 embodying the invention of this application. The file folder 10 includes a sheet of cardboard or other flexible file folder material which is folded along a fold line 14 to form two portions or panels 16 and 18. Both panels 16 and 18 have an inside surface 20 and an outside surface 22.

Figure 2:
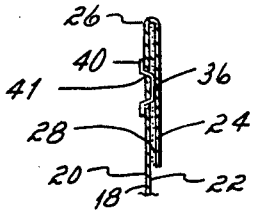
FIG. 2 is a cross-sectional view taken along line 2—2 of FIG. 1.

The two panels 16 and 18 are not of the same size in blank form because the panel 18 has a flap 24 located along its upper edge 26. This flap 24 is folded over the outside surface 22 and is secured to the outside surface 22 by means of an adhesive 28 (FIG. 2).

According to the practice of this invention, two slots 30 are die cut in the panel 18 adjacent the upper edge 26 of the panel 18. These slots are preferably centrally located in the area which is covered by the flap 24. The slots 30 are spaced apart by a medial portion 32 of the file folder and are colinearly aligned, elongate slots.

Attached to the outside surface 22 of the file folder there is a metal fastener 34. This fastener 34 has a central body portion 36 and two prongs 38 extending from opposite ends of the central body portion 34. Lugs or tabs 40 extend laterally from the elongate central body portion 36 of the fastener 34.

The central body portion 36 of the fastener is sandwiched between the flap 24 and the outside surface 22 of the folder with the lugs or tabs 40 extending through narrow slots or slits 41 in the medial portion 32 of the folder. The fastener is secured to the folder by having the lugs or tabs 40 bent into juxtaposition with the inside surface 20 of the medial portion of the folder between the slots after those tabs or lugs have been passed through the slits 41.

After attachment of the fastener 34 to the outside surface of the folder, the flap 24 is folded downwardly over the central portion 36 of the fastener 34 and secured by adhesive 28 so as to cover the complete fastener. Thereby, the fastener is covered by the flap and is left unexposed so that it cannot catch on other files or other articles when the folder is filed in a conventional filing cabinet. In addition to covering the fastener and preventing it from hanging up on other articles or files, the flap also functions to strengthen the file folder in the are of the fastener.

As should now be readily evident, the assembly or attachment of the fastener 34 to the sheet 12 of the folder 10 may be accomplished while the fastener is maintained in a flat planar state. That is, it is not necessary to bend the prongs 38 at right angles to the central body portion 36 in order to insert the prongs through slots or holes 30 of the folder and then fold the prongs back into the plane of the folder as is conventional in prior folders of the type utilizing sheet metal fasteners. As explained more fully hereinafter, the machinery and equipment utilized to attach the fastener 34 to the sheet 12 may be substantially less complicated and expensive than machinery and equipment which has heretofore been required to bend the fastener in order to attach it to the folders.

Figure 3:
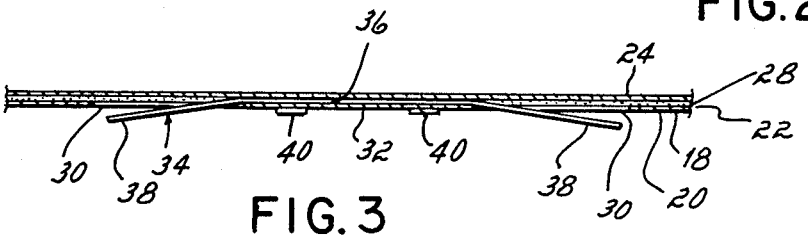
FIG. 3 is a cross-sectional view taken along line 3—3 of FIG. 1.
Figure 4:
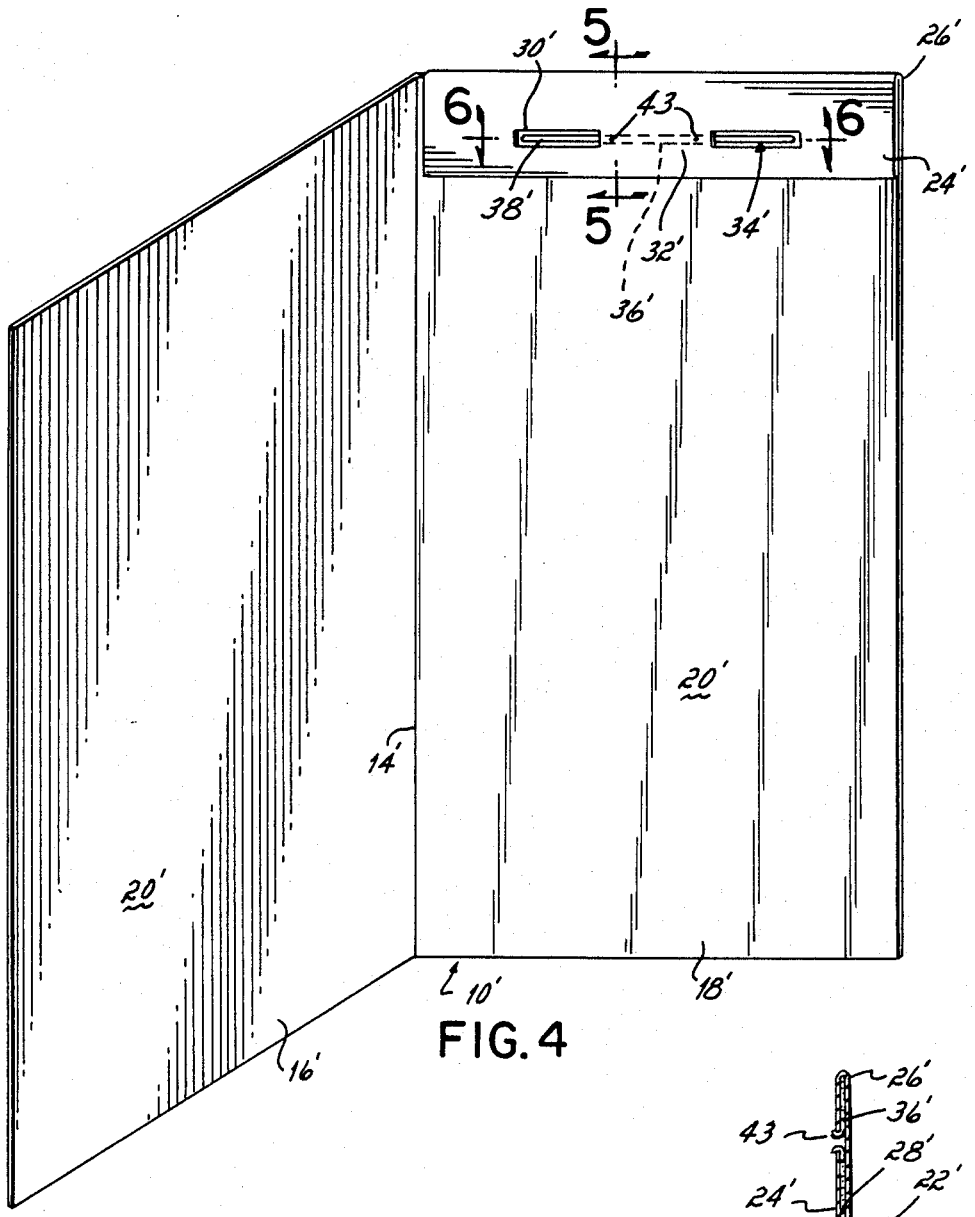
FIG. 4 is a perspective view of a second embodiment of the invention of this application.
Figure 5:
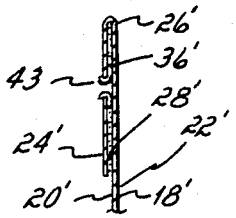
FIG. 5 is a cross-sectional view taken along line 5—5 of FIG. 4.
Figure 6:
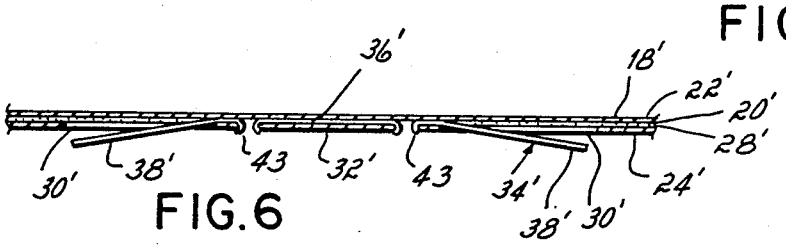
FIG. 6 is a cross-sectional view taken along 6—6 of FIG. 4.

With reference now to FIGS. 4, 5 and 6 there is illustrated a second embodiment of a file folder 10′ manufactured in accordance with the invention of this application. This folder 10′ is similar to the embodiment of FIGS. 1–3. To the extent that the folders are similar or even identical, common reference numerals have been used in both embodiments. In this second embodiment, though, the fastener 34′, instead of being secured to the panel 18 is attached to the flap 24′. After attachment of the fastener to the flap 24′, the fastener is bent over towards the inside surface 20′ of the panel 18′ and is secured thereto by adhesive 28′.

The fastener 34′ of the embodiment of FIGS. 4–6 differs from the fastener 34 of the embodiment of FIGS. 1–3 in that the fastener does not have lugs or tabs 40 extending from the central body portion 36′ of the fastener. Instead, it has rivets 43 formed by punching metal from the central body portion 36′ of the fastener. When the fastener is secured to the medial portion 32′ of the flap 24′, these rivets 43 are bent or flared outwardly on the opposite side of the flap from the side on which the fastener resides so as to secure the fastener to the flap.

In the manufacture of the embodiment of FIGS. 4–6, the fastener is attached to the inside surface of the flap 24′ after which the inside surface of the flap is folded downwardly against the inside surface 20′ of the panel 18′. The inside surface of the panel 18′ is then adhesively secured to the inside surface of the flap 24′ so as to sandwich the fastener 34′ between the medial portion 32′ of the flap and the inside surface of the panel 18′.

Figure 7:
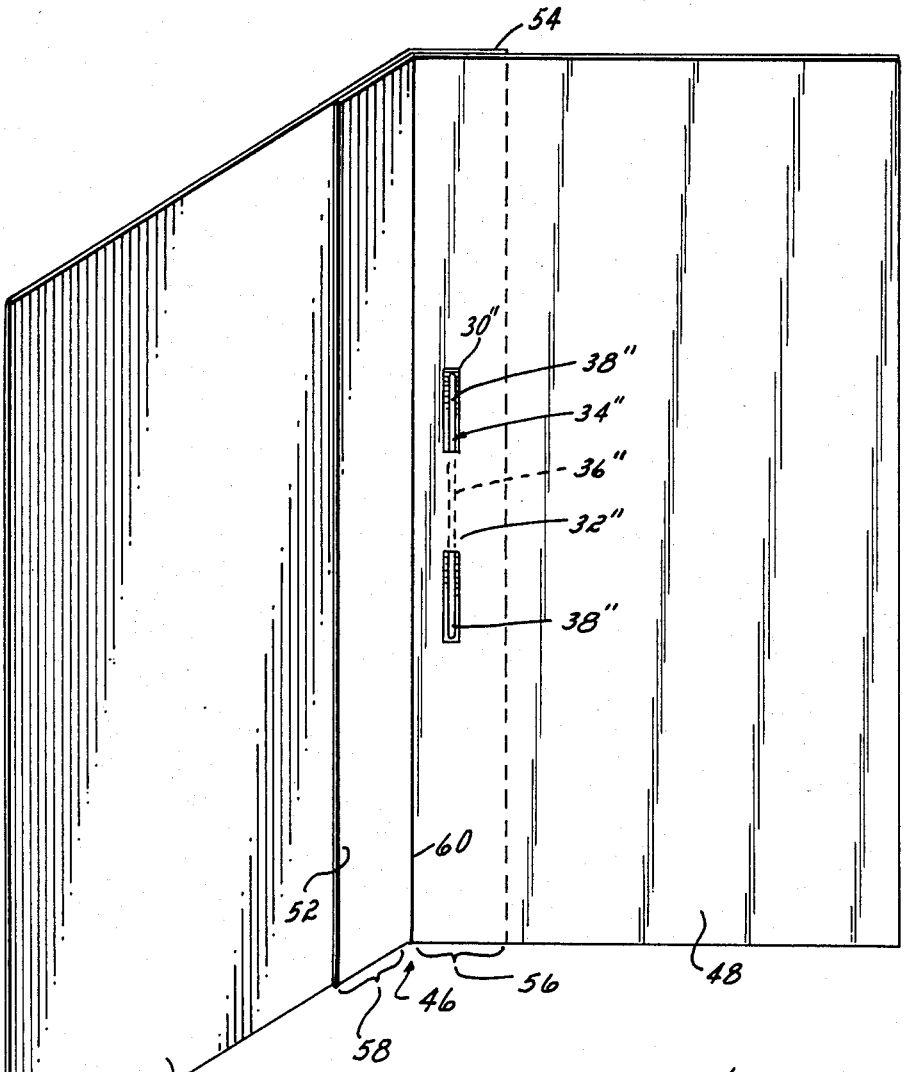
FIG. 7 is a perspective view of a third embodiment of a folder and fastener combination incorporating the invention of this application.
Figure 13:
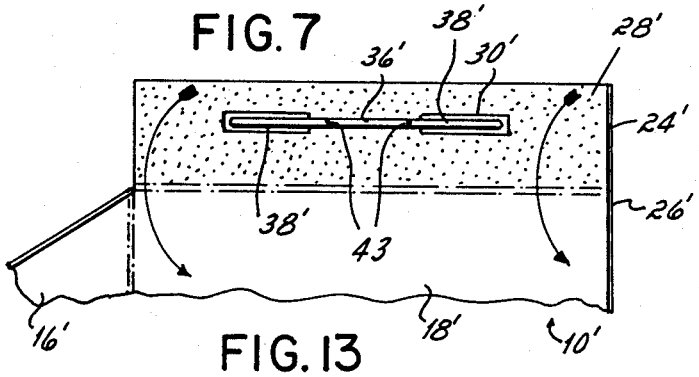
FIG. 13 is a perspective view of the final step in the manufacture of the assembled folder and fastener of FIG. 4 after completion of the steps illustrated in FIGS. 8–12.

With reference now to FIG. 7 there is illustrated yet another embodiment of a file folder 46 incorporating the invention of this application. This file folder 46 is formed from two separate sheets or panels 48 and 50. The sheet or panel 48 has a flap 52 along its left-hand edge as viewed in FIG. 7, and the sheet 50 has a similar flap 54 along its right-hand edge as viewed in this Figure. The flap 54 is adhesively secured to the underneath side of the leftwardmost region 56 of the sheet or panel 48 adjacent its flap 52, and, similarly, the underneath side of the flap 52 is secured to the inside surface of a region 58 of the sheet or panel 50 adjacent its flap 54. The sheets or panels 48 and 50 are folded relative to one another and to their flaps 52 and 54 along a fold line 60. Two elongated slots 30″ are provided in the sheet 48 in the region 56, the slots being colinearly aligned and spaced apart by a medial portion 32″. A fastener 34″, identical to the fastener 34′, is secured to the outside surface of the panel 48. This fastener 34″ has a central body portion 36″ and end prongs 38″ extending outwardly from the central body portion 36″. The body 36″ of the fastener 34″ is secured to the medial portion 32″ of the folder by rivets 43″ which extend through the medial portion 32″ of the panel 48 and are flared outwardly on the inside surface thereof. After securement of the fastener 34'' to the medial portion 32'' of the panel 48, with the central body portion of the fastener located adjacent the outside surface of the panel 48, the flap 54 of the panel 50 is secured over the fastener and to the outside surface of the panel 48, while simultaneously, the outside surface of the flap 52 is adhesively secured to the inside surface of the panel 50.

In the use of the file folders of all three embodiments disclosed in this application, loose papers are attached to the inside of the file folders by bending the prongs 38, 38', or 38'' upwardly through the slots 30, 30' or 30'' of the file folders. After mounting of the loose papers upon the prongs by inserting holes of the loose papers through the prongs, the prongs are bent downwardly, and thereby the loose papers are secured within the inside of the folder.

With reference now to FIGS. 8–13, there is illustrated the method of manufacturing the file folder illustrated in FIGS. 4–6. Specifically, FIGS. 9–12 illustrate the manner of manufacturing the fastener 34' and of attaching the fastener to the file folder 10'. Substantially, this same method and apparatus, though, is utilized to manufacture the fasteners and secure the fasteners to the file folders of the other embodiments.

Figure 8:
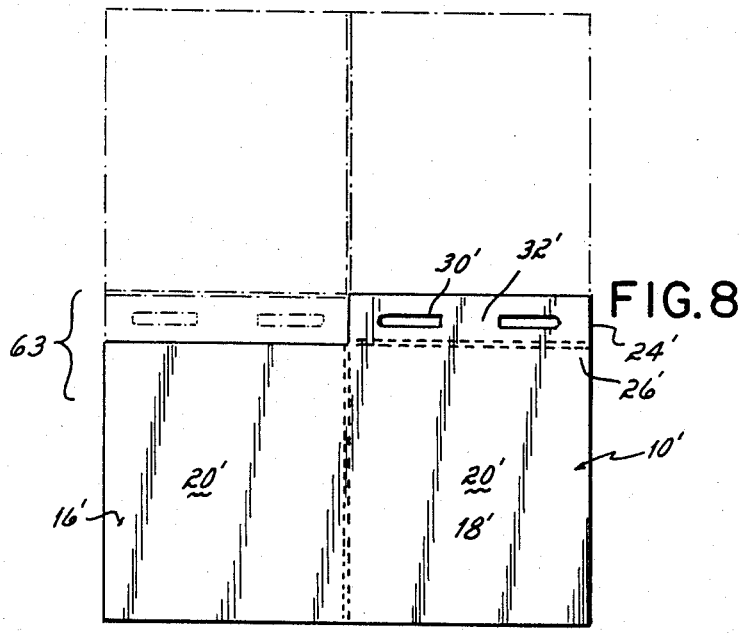
FIG. 8 is a top plan view of a sheet of cardboard or other flat material used in forming the folder illustrated in the embodiments of FIGS. 1 and 4.
Figure 12:
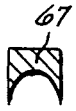
FIG. 12 is a cross-sectional view taken on line 12—12 of FIG. 9.

With reference first to FIG. 8, it will be seen that two file folders are die cut from a single rectangular blank or sheet of material 63 without there being any scrap resulting from the manufacture of the blanks other than that which is generated when the elongated slots 30' are die cut from the file folders. In FIG. 8, one file folder 10' is illustrated in solid lines, and an identical file folder is illustrated in phantom lines. While in this Figure the file folders are illustrated as being die cut from a rectangular sheet of flat sheet material, the folders could as well be cut from a roll of flat sheet material without the creation of any more scrap than is created from the cutting of the folders from rectangular blanks of sheet material.

Figure 10:
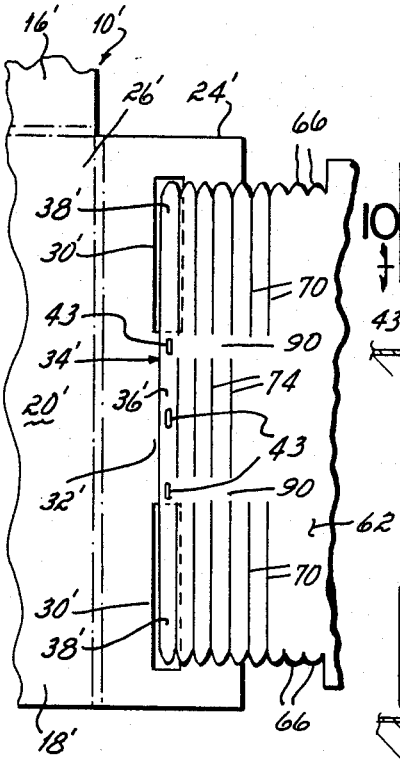
FIG. 10 is a cross-sectional view taken on line 10—10 of FIG. 9.
Figure 9:
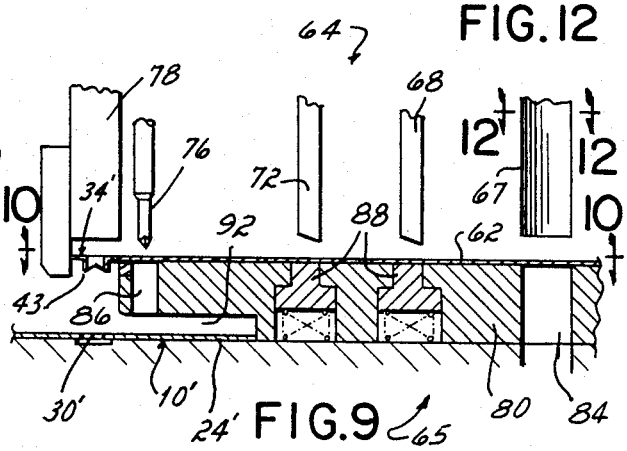
FIG. 9 is a side elevational view, partially in cross section, of a die set utilized in the manufacture and assembly of the fastener and folder combination of this invention.
Figure 11:
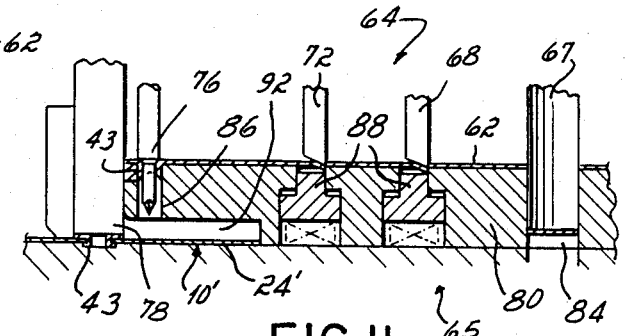
FIG. 11 is a cross-sectional view similar to FIG. 9 illustrating the die set of FIG. 9 in an actuated position.

With reference now to FIGS. 9–11, it will be seen that the fasteners 34' are die cut from a flat sheet of metal 62 which is sequentially fed through a die set 65. This die set 65 comprises a die plate 80 and a series of cutting and forming dies. These cutting and forming dies 64 include a pair of end punches 67 (only one of which is shown) operative to form the ends 66 of the fasteners 34', a pair of cutter dies 68 (only one of which is shown) operative to form cuts 70, which delineate the prongs 38', on the leading and/or trailing sides of the fasteners 34', a single cutter die 72 operative to form a center cut 74 that delineates the central portion 36' on the leading and/or trailing edges of the fasteners, and multiple punches 76 operative to punch and form the rivets 43 in the fasteners 34'. Additionally, the die set includes a cutoff die 78 operative to shear the endmost partially formed fastener 34' from the sheet of metal 62 and to move that sheared fastener 34' into contact with a folder 10' located beneath the die set 65. The die plate 80 is located on the underside of the sheet metal plate 62 from which the fasteners are cut while the punches, cutter dies, and cutoff dies are located above the sheet 62. The die plate 80 is provided with vertical bores or holes 84, 86 located beneath the punches 67, 76, respectively, and cooperable with those punches to form the ends 66 and rivets 43 of the fasteners. The die plate also has striker plates 88 mounted therein. These striker plates are vertically movable within the die plate and are spring loaded upwardly so as to locate the top surface of the striker plates in horizontal alignment with the top surface of the die plate 80 until such time as the cutter dies move downwardly to cut and form the leading and trailing edges of the fasteners 34'.

In the use of the die set 65 to cut and form the fasteners 34' from the plate of sheet metal 62, the plate of sheet metal 62 is incrementally fed leftward as viewed in FIGS. 9–11 through the die set 65 as the dies and punches are reciprocated vertically. In the course of passage through the die set, the ends 66 of the fasteners 34 are first formed by the punches 67. Simultaneously, fasteners upon which the ends have already been formed pass beneath the cutter dies 68 which are operative to make the cuts 70 to partially form the leading and trailing edges of the fasteners. Simultaneously, partially formed fasteners which have already passed beyond the cutter dies 68 are engaged by the cutter die 72 to cut and form the center portion 74 of the leading and trailing edges of the fasteners. In the course of continuing to move leftward through the die set as pictured in FIGS. 9–11, the partially formed fasteners pass beneath the punches 76 which, in the course of passing through the partially formed fasteners, form the rivets 43.

The endmost or forwardmost partially formed fastener 34' is completely formed except that it is still connected to the sheet 62 by uncut sections 90 of the sheet. When the die set is moved downwardly, this partially formed endmost fastener is sheared from the sheet 62 by the cutoff die 78, which is then operative to cause the endmost fastener to move downwardly and force the rivets 43 through the medial portion 32' of a folder located in a slot 92 of the die plate 80. After passage through the folder 42, the rivets 43 are flared outwardly so as to clamp the fastener 34' to the folder 10'. After securement of the fastener 34' to the folder 10', the folder is removed from the die set 65 and the flap 24' is folded (FIG. 13) and adhesively secured to the inside surface of the panel 18'.

As should now be readily evident, the primary advantage of the file folder of this invention is the ease with which it enables the fasteners to be attached to the file folder with die sets working only on one side of the folder and without the need to bend the fasteners in order to insert them through slots or holes of the folder. As a result of this construction, the equipment and machinery required to manufacture the fasteners and to secure them to the folder is much less expensive than has heretofore been required to effect the complex bending operation required for this attachment. This invention also lends itself to covering of the exposed portion of the fastener with a flap or cover so as to prevent that exposed portion of the fastener from hanging up and damaging files of adjacent folders when the folder is utilized in a file cabinet of multiple folders.

While I have described only three preferred embodiments of my invention and one method of manufacturing and assembling it, persons skilled in this art will appreciate changes and modifications which may be made without departing from the spirit of my invention. Therefore, I do not intend to be limited except by the scope of the following appended claims.

I claim:

1. In combination, a folder and a fastener for securing loose papers to the folder, said folder having a pair of opposed faces and a pair of opposed side edges, said folder having a third edge, said folder having a pair of spaced, colinearly aligned, elongated slots, said slots terminating prior to said side edges and being separated by a medial portion of said folder, said slots being located adjacent to and spaced from said third edge, said pair of slots having near ends and remote ends, said fastener consisting of an elongated strip of sheet material, said fastener having a central body portion and a pair of opposed, elongated prongs extending from opposite ends of the central body portion, said fastener terminating at the ends of said prongs, said central body portion of said fastener overlying said medial portion of said folder on one face of said folder, said central body portion of said fastener being secured to said medial portion of said folder, and said prongs of said fastener overlying said spaced, elongated slots of said folder, a cover strip, said cover strip being located over said one face of said folder and over said fastener, whereby said central body portion of said fastener is located between said cover strip and said folder, said cover strip being adhesively secured to said folder, whereby said prongs may be bent upwardly on the opposite face for securement or removal of loose papers relative thereto and bent downwardly to retain papers mounted thereon.

2. The combination of claim 1 wherein said central body portion of said fastener is secured to said medial portion of said folder by tabs of said fastener extending through slots of said folder and bent over said medial portion of said folder.

3. The combination of claim 1 wherein said central body portion of said fastener is secured to said medial portion of said folder by rivets punched from said central body portion of said fastener and extending through said medial portion of said folder.

4. The combination of claim 1 wherein said cover strip comprises a flap of said folder, said flap extending from said third edge of said folder.

5. In combination, a folder and a fastener for securing loose papers to the folder, said folder having a panel with first and second opposed faces and a pair of opposed side edges, said panel having a third edge, said panel having a pair of spaced, colinearly aligned, elongated slots, said slots being located adjacent to and spaced from said third edge, said slots being separated by a medial portion of said panel and, said folder further having a cover strip, said fastener consisting of an elongated strip of sheet material, said fastener having a central body portion and a pair of opposed, elongated prongs extending from opposite ends of the central body portion, said central body portion of said fastener overlying said medial portion of said panel on said first face of said panel, said central body portion of said fastener being secured to said medial portion of said panel, with said prongs located in said elongated slots in said panel, said cover strip being on said first face of said panel and over said fastener, whereby said central body portion of said fastener is located between said cover strip and said panel, said cover strip being adhesively secured to said panel, whereby said prongs may be bent upwardly from said second face through said elongated slots for securement or removal of loose papers and bent downwardly to retain papers mounted thereon.

6. The combination of claim 5 wherein said cover strip is part of a further panel which is adjacent said third side edge of said panel.

7. In combination, a folder and a fastener for securing loose papers to the folder, said folder having a panel with first and second opposed faces and a pair of opposed side edges, said folder further having a support strip adhesively secured to the panel adjacent a third side edge on said first face and extending between said opposed side edges, said support strip having a pair of spaced, colinearly aligned, elongated slots, said slots being separated by a medial portion of said support strip and said slots being parallel with and spaced from said third side edge, said fastener consisting of an elongated strip of sheet material, said fastener having a central body portion and a pair of opposed, elongated prongs extending from opposite ends of the central body portion, said central body portion of said fastener being located between said panel and said support strip with said body portion overlying said medial portion of said support strip with said prongs located in said elongated slots in said support strip, whereby said prongs may be bent upwardly from said first face through said elongated slots for securement or removal of loose papers and bent downwardly to retain papers mounted thereon.

* * * * *